United States Patent [19]

Adaniya et al.

[11] 4,048,381

[45] Sept. 13, 1977

[54] METHOD FOR MANUFACTURING AN ELECTRO-GALVANIZED STEEL SHEET EXCELLENT IN BARE CORROSION RESISTANCE AND ADAPTABILITY TO CHROMATING, AND PRODUCT THEREOF

[75] Inventors: Takeshi Adaniya; Masaru Ohmura, both of Fukuyama, Japan

[73] Assignee: Nippon Kokan Kabushiki Kaisha, Tokyo, Japan

[21] Appl. No.: 644,905

[22] Filed: Dec. 29, 1975

[30] Foreign Application Priority Data

Jan. 22, 1975 Japan ..... 50-8627
Mar. 28, 1975 Japan ..... 50-36891

[51] Int. Cl.[2] ..... B23P 3/00; C25D 3/56; C25D 5/48

[52] U.S. Cl. ..... 428/632; 148/31.5; 204/35 R; 204/38 R; 204/43 Z

[58] Field of Search ..... 204/43 Z, 43 T, 35 R, 204/40, 56 R; 29/195 T; 428/632

[56] References Cited

U.S. PATENT DOCUMENTS

| | | | |
|---|---|---|---|
| 3,791,801 | 2/1974 | Ariga et al. | 29/196.5 |
| 3,822,118 | 7/1974 | Fukuzuka et al. | 29/183.5 |
| 3,966,564 | 6/1976 | Hyner et al. | 204/43 S |

FOREIGN PATENT DOCUMENTS

| | | | |
|---|---|---|---|
| 160,410 | 1/1964 | U.S.S.R. | 204/43 Z |
| 201,871 | 11/1967 | U.S.S.R. | 204/43 T |
| 246,251 | 6/1969 | U.S.S.R. | 204/43 T |
| 254,296 | 3/1970 | U.S.S.R. | 204/43 Z |

*Primary Examiner*—F.C. Edmundson
*Attorney, Agent, or Firm*—Flynn & Frishauf

[57] ABSTRACT

In a Zn-ion based acidic galvanizing bath containing at least one additive selected from the group consisting of:

| | |
|---|---|
| (a) $Cr^{3+}$ | 50 - 700 ppm, |
| (b) $Cr^{6+}$ | 50 - 500 ppm, |
| (c) $Cr^{3+}$ and $Cr^{6+}$ | 50 - 700 ppm, in which $Cr^{6+}$ being 500 ppm at the maximum, |
| (d) In ion | 10 - 3,000 ppm, and |
| (e) Zr ion | 10 - 2,500 ppm; |
| and: | |
| (f) Co ion | 50 - 10,000 ppm, |

a steel sheet is subjected to an electro-galvanizing treatment to form a first galvanizing layer on the surface thereof; and then, said electro-galvanized steel sheet with said first galvanizing layer formed thereon to a conventional chromate treatment.

With a view to further increasing the amount of deposited chromate on said chromated electro-galvanized steel sheet, said electro-galvanized steel sheet with said first galvanizing layer formed thereon is subjected to another electro-galvanizing treatment in a conventional acidic galvanizing bath containing zinc only to form a second galvanizing layer consisting exclusively of at least 0.2 g/m² zinc on said first galvanizing layer; and then, said electro-galvanized steel sheet with said first and said second galvanizing layers formed thereon is subjected to a conventional chromate treatment.

4 Claims, No Drawings

METHOD FOR MANUFACTURING AN ELECTRO-GALVANIZED STEEL SHEET EXCELLENT IN BARE CORROSION RESISTANCE AND ADAPTABILITY TO CHROMATING, AND PRODUCT THEREOF

FIELD OF THE INVENTION

The present invention relates to an improvement in the process for manufacturing a chromated electro-galvanized steel sheet, said process comprising subjecting a steel sheet to an electro-galvanizing treatment in an acidic galvanizing bath containing Co, and then, subjecting said electro-galvanized steel sheet to a chromate treatment.

BACKGROUND OF THE INVENTION

It is in general inevitable that impurities from a galvanizing apparatus, an electrode, galvanizing bath materials and a steel sheet to be electro-galvanized are entangled into a galvanizing bath during electro-galvanizing operations of the steel sheet. Impurities thus mixed into the galvanizing bath not only causes degradation of the surface quality of the produced galvanizing layer, but also exert adverse effects on a chromate treatment to be applied thereafter. If, for example, a galvanizing bath contains $Fe^{2+}$ mixed in it as impurities, formation of a chromate film on the galvanizing layer of an electro-galvanized steel sheet is seriously impaired in applying a chromate treatment as the next step, and hence, the amount of deposited chromate is largely reduced. If, furthermore, impurities such as $Cu^{2+}$ and $Ni^{2+}$ are contained in a galvanizing bath, the amount of chromate deposited onto the galvanizing layer of an electro-galvanized steel sheet is small in applying a chromate treatment. Consequently, an intensification of chromate treatment conditions, as described later, cannot increase at all the amount of deposited chromate. As a result, it is impossible to obtain a chromated electro-galvanized steel sheet having a satisfactory corrosion resistance.

For the purpose of preventing impurities from coming into a galvanizing bath, or removing impurities from a galvanizing bath, it has been usual practice to apply a closer control over impurities in a galvanizing bath, to employ a corrosion resistant material for the construction of a galvanizing apparatus, to remove such impurities as cadmium, lead and copper dissolved in a galvanizing bath by substituting zinc for such impurities through a treatment of the galvanizing bath with zinc powder, or, to cause precipitation of such impurities as copper by suspending an iron plate in a galvanizing bath.

On the other hand, a method for intensifying chromating conditions is conventionally known, which comprises increasing the amount of deposited chromate by increasing the amount of free acid in a chromating bath, with a view to imparting a satisfactory corrosion resistance to an electro-galvanized steel sheet of which the galvanizing layer has been degraded by impurities in the galvanizing bath. The chromating bath in this method has however a strong pickling action because of its increased free acid. This method is therefore defective in that the formation of a chromate film becomes non-uniform or the increased dissolution of zinc into the chromating bath accelerates the degradation of the chromating bath. Even by such an intensification of chromating conditions, therefore, the time before occurrence of white rust in a salt spray test, for example, is not extended so much, and an improvement of the corrosion resistance of a chromated electro-galvanized steel sheet cannot be expected.

In all cases, these conventional measures to prevent impurities from coming into a galvanizing bath, to remove impurities from a galvanizing bath and to intensify chromating conditions are only passive actions aiming at preventing the adaptability of chromating of an electro-galvanized steel sheet from being impaired by impurities mixed in a galvanizing bath. These measures cannot therefore be positive actions imparting a higher corrosion resistance to an electro-galvanized steel sheet by improving its adaptability to chromating.

In view of the foregoing, the following methods have so far been proposed:

1. Method which comprises electro-galvanizing a steel sheet in a galvanizing bath containing added Mo and W (refer to the Japanese Patent Publication No. 25,245/71);
2. Method which comprises electro-galvanizing a steel sheet in a galvanizing bath containing added Co, Mo, W and Fe (refer to the Japanese patent Publication No. 16,522/72);
3. Method which comprises electro-galvanizing a steel sheet in a galvanizing bath containing added Co, Mo, W, Ni, Sn, Pb and Fe (refer to the Japanese Patent Publication No. 19,979/74);
4. Method which comprises electro-galvanizing a steel sheet in a galvanizing bath containing added 0.05 – 0.3 g/l $Cr^{6+}$ (refer to the Japanese Patent Provisional Publication No. 84,040/73); and
5. Method which comprises electro-galvanizing a steel sheet in a galvanizing bath containing added 0.05 – 1.5 g/l Zr (refer to the Japanese patent Publication No. 18,202/70).

All these methods (1) to (5) have an object to improve the quality of the galvanizing layer itself of an electro-galvanized steel sheet. The adaptability to chromating of an electro-galvanized steel sheet is not therefore improved by any of these methods, thus leading to no improvement in the corrosion resistance of the electro-galvanized steel sheet after a chromate treatment.

The amount of deposited zinc is in general smaller in an electro-galvanized steel sheet than in a hot-dip galvanized steel sheet. Consequently, an electro-galvanized steel sheet has been superior to a hot-dip galvanized steel sheet in terms of the formability, but has inevitably been inferior to the latter in terms of the corrosion resistance of its galvanizing layer itself (hereinafter called the "bare corrosion resistance"). In this respect, a galvanizing layer containing Co, as in methods (2) and (3) above, has certainly an improved bare corrosion resistance, but in contrast, shows a lower adaptability to chromating, hence a smaller amount of deposited chromate, as described above.

In view of the foregoing, a process for manufacturing a chromated electro-galvanized steel sheet has been proposed (refer to the Japanese Patent Provisional Publication No. 102,538/75), with a view to increasing the amount of deposited chromate by the improvement of the adaptability to chromating of an electro-galvanized steel sheet and thus to improving the corrosion resistance of the electro-galvanized steel sheet after chromating, said process comprising: electro-galvanizing a steel sheet in a Zn-ion based acidic galvanizing bath containing an additive selected from the group consisting of:

| | |
|---|---|
| (a) $Cr^{3+}$ | 50 - 700 ppm, |
| (b) $Cr^{6+}$ | 50 - 500 ppm, and |
| (c) $Cr^{3+}$ and $Cr^{6+}$ | 50 - 700 ppm, in which $Cr^{6+}$ being 500 ppm at the maximum; |

and then subjecting said electro-galvanized steel sheet to a chromate treatment. According to this method, the time before occurrence of white rust is largely extended, but sufficiently satisfactory results are not as yet available in terms of the time before occurrence of red rust.

In view of these facts, it has been hoped to have a process for manufacturing a chromated electro-galvanized steel sheet having not only an excellent bare corrosion resistance but also an excellent corrosion resistance after a chromate treatment, but no such process has as yet been proposed.

SUMMARY OF THE INVENTION

An object of the present invention is therefore to provide a process for manufacturing a chromated electro-galvanized steel sheet having a high bare corrosion resistance of its galvanizing layer itself and an excellent corrosion resistance after a chromate treatment as well as a smaller degradation in the deep-drawing formability caused by a secular change.

In accordance with one of the features of the present invention, there is provided a method for manufacturing a chromated electro-galvanized steel sheet which comprises subjecting a steel sheet to an electro-galvanizing treatment in a Zn-ion based acidic galvanizing bath containing at least one additive selected from the group consisting of:

| | |
|---|---|
| (a) $Cr^{3+}$ | 50 - 700 ppm, |
| (b) $Cr^{6+}$ | 50 - 500 ppm, |
| (c) $Cr^{3+}$ and $Cr^{6+}$ | 50 - 700 ppm, in which $Cr^{6+}$ being 500 ppm at the maximum, |
| (d) In ion | 10 - 3,000 ppm, and |
| (e) Zr ion | 10 - 2,500 ppm; |
| and | |
| (f) Co ion | 50 - 10,000 ppm, |

to form a first galvanizing layer on the surface thereof; and then, subjecting said electro-galvanized steel sheet with said first galvanizing layer formed thereon to a conventional chromate treatment.

The process of the present invention includes a process for manufacturing a chromated electro-galvanized steel sheet, which comprises: subjecting said electro-galvanized steel sheet having said first galvanizing layer formed thereon to a second electro-galvanizing treatment in a conventional acidic galvanizing bath containing zinc only to form a second galvanizing layer consisting exclusively of at least 0.2 g/m² zinc on said first galvanizing layer; and then, subjecting said electro-galvanized steel sheet having said first and said second galvanizing layers formed thereon to a conventional chromate treatment.

DETAILED DESCRIPTION OF PREFERRED EMBODIMENTS

In view of the foregoing, the inventors have conducted an extensive study, and found as a result that a chromated electro-galvanized steel sheet having an excellent bare corrosion resistance and also an excellent corrosion resistance after a chromate treatment, can be obtained by subjecting a steel sheet to an electro-galvanizing treatment in a Zn-ion based acidic galvanizing bath containing at least one additive selected from the group consisting of:

| | |
|---|---|
| (a) $Cr^{3+}$ | 50 - 700 ppm, |
| (b) $Cr^{6+}$ | 50 - 500 ppm, |
| (c) $Cr^{3+}$ and $Cr^{6+}$ | 50 - 700 ppm, in which $Cr^{6+}$ being 500 ppm at the maximum; |
| (d) In ion | 10 - 3,000 ppm, and |
| (e) Zr ion | 10 - 2,500 ppm; |
| and: | |
| (f) Co ion | 50 - 10,000 ppm, |

to form a first galvanizing layer on the surface thereof; and then, subjecting said electro-galvanized steel sheet with said first galvanizing layer formed thereon to a conventional chromate treatment. The process comprising the steps mentioned above is hereinafter called "the first process" of the present invention.

The performance of said additives in the present invention, although not clearly known, is estimated to be that Co, which inhibits dissolution of Zn through the passivation of the surface of the galvanizing layer of a steel sheet, improves the bare corrosion resistance of an electro-galvanized steel sheet. On the other hand, however, the surface of a galvanizing layer becomes electrochemically inactive (noble), thus leading to a lower adaptability to chromating of the electro-galvanized steel sheet.

Cr, In and Zr all activate (render base) the surface of a galvanizing layer and tend to raise the adaptability to chromating of the electro-galvanized steel sheet. These—Cr, In and Zr—are therefore considered to make up for the drawbacks of Co, and, in cooperation with Co, improve the bare corrosion resistance of an electro-galvanized steel sheet and raise its adaptability to chromating.

The base of a galvanizing bath employed in the present invention may be a conventional acidic galvanizing bath. More specifically, zinc sulfate ($ZnSO_4 \cdot 7H_2O$) or zinc chloride ($ZnCl_2$) is applicable as a main Zn source; ammonium chloride ($NH_4Cl$) or other ammonium salt ($NH_4X$), as an conductive assistant; and sodium acetate ($CH_3COONa$) or sodium succinate ($(CH_2COONa)_2 \cdot 6H_2O$), as a pH buffer. For example, an acidic galvanizing bath of a pH of about 4, containing $ZnSO_4 \cdot 7H_2O$:440 g/l; $ZnCl_2$:90 g/l; $NH_4Cl$:12 g/l; and $(CH_2COONa)_2 \cdot 6H_2O$:12 g/l, is well applicable as a base for the galvanizing bath in the present invention without any special treatment.

The electro-galvanizing conditions in the present invention may also be conventional ones, without the necessity of any modification. For example, a steel sheet may be electro-galvanized at a bath temperature of about 50° C and with a current density of about 45 A/dm².

Now, the following paragraphs explain the effects of the above-mentioned elements to be added into a conventional acidic galvanizing bath, and the reasons why, in the present invention, the amounts of these elements are limited as mentioned above.

1. Co ion

Co is considered to be present in the form of oxides and/or hydroxides in the galvanizing layer of an electro-galvanized steel sheet, which passivate the surface of the galvanizing layer and thus inhibit dissolution of Zn, improving the bare corrosion resistance of said galvanizing layer.

Two steel sheets were tentatively electro-galvanized, one in a conventional acidic galvanizing bath based on zinc sulfate and added with ammonium chloride and a pH buffer, and the other in another acidic galvanizing bath prepared by adding cobalt sulfate ($CoSO_4$) into said conventional bath, at a current density of 45 $A/dm^2$, so as to give an amount of deposited zinc of 20 $g/m^2$, and then subjected to a chromate treatment by dipping said electro-galvanized steel sheets in a commercial reactive-type chromating solution. Measurement of the natural electric potential on said chromated electro-galvanized steel sheets have shown that the chromated electro-galvanized steel sheet treated in the Co-containing galvanizing bath had a far lower natural electric potential (noble) than in that treated in the galvanizing bath not containing Co. This indicates that the addition of Co renders a galvanizing layer inactive (noble). The amount of deposited chromate of the chromated electro-galvanized steel sheet having the Co-containing galvanizing layer, as measured by fluorescent X-ray, was only about one third that in the chromated electro-galvanized steel sheet having a galvanizing layer not containing Co. This suggests that an electro-galvanized steel sheet with a Co-containing galvanizing layer has a lower adaptability to chromating.

As is clear from the foregoing, Co is an element very favorable in improving the bare corrosion resistance of an electro-galvanized steel sheet. On the other hand, however, Co impairs the adaptability to chromating of a galvanizing layer. Furthermore, a galvanizing bath, when containing too much Co, not only causes a non-uniform dissolution of a zinc electrode, but also causes precipitation of a relatively large quantity of oxides in the resulting galvanizing layer, which blacken the galvanizing layer and impair the product quality. A Co-ion content of a galvanizing bath of over 10,000 ppm thus degrades the adaptability to chromating and the external appearance of an electro-galvanized steel sheet, and no improvement is observed in its bare corrosion resistance. It is therefore necessary to limit the Co-ion content to 10,000 ppm at the maximum. At a Co-ion content of under 50 ppm, on the other hand, it is impossible to obtain a desired bare corrosion resistance of a galvanizing layer itself.

It is desirable to use a water-soluble compound such as cobalt sulfate, cobalt chloride or cobalt acetate, as an additive for forming Co ion in a galvanizing bath of the present invention.

2. $Cr^{3+}$ and $Cr^{6+}$ $Cr^{3+}$ and $Cr^{6+}$ are chemically absorbed in the form of oxides and/or hydroxides of Cr into the galvanizing layer of an electro-galvanized steel sheet, which are estimated to serve as nuclei on the formation of a chromate film and promote the growth of the chromate film. Moreover, the coexistence of oxides and/or hydroxides of Cr and Co in a galvanizing layer brings about a further improvement of the bare corrosion resistance of an electro-galvanized steel sheet.

A $Cr^{3+}$ content of over 700 ppm in a galvanizing bath is not desirable because of a portion remaining undissolved in the galvanizing bath. Also, a $Cr^{6+}$ content of over 500 ppm in a galvanizing bath impairs the adhesion of zinc to steel sheet and produces irregularities in the galvanizing layer, thus giving an unfavorable external appearance to the electro-galvanized steel sheet. Furthermore, an excessive content of $Cr^{6+}$ in a galvanizing bath inhibits formation of a galvanizing film. On the other hand, a content of $Cr^{3+}$ and/or $Cr^{6+}$ of under 500 ppm, posing no problems in the formation of a galvanizing film, the adhesion of the galvanizing film to a steel sheet, and the external appearance of an electro-galvanized steel sheet, gives no improvement in the adaptability to chromating of an electro-galvanized steel sheet.

It is desirable to use a water-soluble compound such as chromium sulfate, chromium nitrate or chromium-ammonium sulfate, as an additive for forming $Cr^{3+}$ in a galvanizing bath of the present invention, and a water-soluble compound such as bichromic acid, chromic acid, or an alkali or an ammonium salt thereof, as an additive for forming $Cr^{6+}$. Because $Cr^{3+}$ cannot be easily dissolved in a galvanizing bath, it is advisable to dissolve in advance said additive in hot water and add the solution into the galvanizing bath to facilitate dissolution of $Cr^{3+}$ into the galvanizing bath.

3. In ion

The coexistence of In and Co in a galvanizing layer further improves the bare corrosion resistance of an electro-galvanized steel sheet.

However, an In-ion content of over 3,000 ppm in a galvanizing bath, posing no problems in the formation of a galvanizing film, the adhesion of the galvanizing film to a steel sheet and the adaptability to chromating of an electro-galvanized steel sheet, causes formation of deposits on a galvanizing electrode, thus making it difficult to carry on galvanizing operations. An In-ion content of under 10 ppm, on the other hand, brings about no improvement in the adaptability to chromating of an electro-galvanized steel sheet.

It is desirable to use a water-soluble compound such as indium sulfate or indium chloride, as an additive for forming In ion in a galvanizing bath of the present invention.

4. Zr ion

As in the case of Cr and In, the coexistence of Zr and Co in a galvanizing layer improves the bare corrosion resistance of an electro-galvanized steel sheet.

However, a Zr-ion content in a galvanizing bath of over 2,500 ppm is not desirable because of the tendency of producing precipitates in the galvanizing bath. If the Zr-ion content is under 10 ppm, on the other hand, no improvement is obtained in the bare corrosion resistance and the adaptability to chromating of an electro-galvanized steel sheet.

It is desirable to use a water-soluble compound such as zirconium sulfate or zirconium chloride, as an additive for forming Zr ion in a galvanizing bath of the present invention.

Conditions for a chromate treatment of an electro-galvanized steel sheet following an electro-galvanizing treatment in the present invention may be conventional ones. For example, an electro-galvanized steel sheet may be chromated in a chromating bath containing $CrO_3$: 5–20 g/l with slight amounts of phosphoric and sulfuric acids as additives at a bath temperature of about 40° C for about 2 to 8 seconds.

According to the first process of the present invention described above, there is provided a chromated electro-galvanized steel sheet having a far more excellent bare corrosion resistance and a larger amount of deposited chromate than a chromated electro-galvanized steel sheet with a conventional Co-containing galvanizing layer, in spite of the presence of a similar Co-containing galvanizing layer.

In a chromated electro-galvanized steel sheet obtained by the first process of the present invention, however, despite its increased amount of deposited chromate and remarkably improved corrosion resistance after a chromate treatment under combined effects of the above-mentioned added elements, the amount of deposited chromate is undoubtedly smaller than in a chromated electro-galvanized steel sheet having a galvanizing layer not containing Co, and the product quality may therefore be degraded with time.

More specifically, an electro-galvanized steel sheet has usually a press formability different from that of an ordinary cold rolled steel sheet not galvanized, and the press formability of an electro-galvanized steel sheet depends also on the application of a chemical treatment and the type thereof. In addition, an electro-galvanized steel sheet is characterized in that it has a lower stretch formability but a higher deep-drawing formability.

Chromated electro-galvanized steel sheets with amounts of deposited chromate of 40 mg/m$^2$ and 9 mg/m$^2$, respectively, were manufactured by chromating electro-galvanized steel sheets each having a conventional galvanizing layer not containing any additional element in a commercially available conventional chromating solution. On these steel sheets, the corrosion resistance and the deep-drawing formability were investigated at moments immediately after the manufacture and after a 6-month in-door holding in a packaged form. As a result, almost no difference was observed in the corrosion resistance between the two sheets both immediately after the manufacture and after the lapse of 6 months. With regard to the deep-drawing formability, however, although there was no difference between the two sheets immediately after the manufacture, a serious degradation was observed in the one with an amount of deposited chromate of 9 mg/m$^2$ after the lapse of 6 months.

It was thus found that, depending upon the amount of deposited chromate, the deep-drawing formability of chromated electro-galvanized steel sheets shows a difference with time. The reasons are not clearly known, since the press formability of an electro-galvanized steel sheet exhibits complicated behavior depending on the presence of a chemical treatment, the type of the chemical treatment applied and the lapse of time, unlike that of a cold rolled steel sheet not galvanized. However, it is at least evident that the amount of chromate film is significant.

It may be concluded from these facts that the best way for preventing the secular degradation of the deep-drawing formability of a chromated electro-galvanized steel sheet is to increase the amount of deposited chromate.

As a result of an extensive study on the process for manufacturing a chromated electro-galvanized steel sheet having excellent bare corrosion resistance and corrosion resistance after chromating, less susceptible of secular change in the deep-drawing formability, the inventors found that a chromated electro-galvanized steel sheet with desired properties as mentioned above can be obtained by subjecting the electro-galvanized steel sheet with the first galvanizing layer formed by the first process of the present invention to a second electro-galvanizing treatment in a conventional acidic galvanizing bath containing zinc only, to form a second galvanizing layer consisting exclusively of at least 0.2 g/m$^2$ zinc on said first galvanizing layer; and then, subjecting said electro-galvanized steel sheet with said first and said second galvanizing layers formed thereon to a conventional chromate treatment. The process comprising the steps described above is hereinafter called "the second process" of the present invention.

The thickness of the second galvanizing layer in the second process of the present invention may be very small: a thickness of at least 0.2 g/m$^2$ is sufficient. With a thickness of the second galvanizing layer of under 0.2 g/m$^2$, no improvement is obtained in the adaptability to chromating of an electro-galvanized steel sheet. This is considered attributable to the fact that, in the case of an amount of deposited second galvanizing layer of under 0.2 g/m$^2$, the second galvanizing layer cannot completely cover the above-mentioned first galvanizing layer, and even if it can, its amount is too small to achieve necessary chromating reactions.

In the second process of the present invention, the thickness of the first galvanizing layer may be decided in accordance with the required thickness of the galvanizing layer for a product electro-galvanized steel sheet; one has only to make the total thickness of the first and the second galvanizing layers equal to the required galvanizing layer thickness of a product.

The galvanizing bath for forming the second galvanizing layer in the second process of the present invention may be a conventional acidic galvanizing bath containing zinc only. More specifically, it may be a conventional acidic galvanizing bath used as the base for the galvanizing bath for forming the first galvanizing layer in the first process of the present invention mentioned above. For example, an acidic galvanizing bath containing zinc sulfate or zinc chloride as the Zn-supplying source, ammonium chloride or other ammonium salt as the conductive assistance, and sodium acetate or sodium succinate as the pH buffer, may well be used as a galvanizing bath for forming the second galvanizing layer without any special treatment.

The electro-galvanizing conditions for forming the second galvanizing layer in the second process of the present invention, and the chromating conditions of a electro-galvanized steel sheet with first and second galvanizing layers formed thereon, may be conventional ones, without the necessity of any modification.

Now, the present invention is explained more in detail with reference to examples in comparison with some cases for comparison.

EXAMPLE A

Example A is an embodiment of the first process of the present invention.

a. Chemical composition of base galvanizing bath:
$ZnSO_4 \cdot 7H_2O$: 440 g/l,
$ZnCl_2$: 90 g/l,
$NH_4Cl$: 12 g/l,
$(CH_2COONa)_2 \cdot 6H_2O$: 12 g/l,
b. Conditions for electro-galvanizing treatment:
Cathodic current density: 45 A/dm$^2$,
Bath temperature: 50° C,
pH: 4.0,
Target amount of deposited zinc: 18 g/m$^2$;
c. Conditions for chromate treatment:
Chemicals: Solution made by Nihon Parkerizing Co., Ltd.
Free acid (*F.A.): 5.5 point,
Bath temperature: 40° - 45° C,
Treating time: 4 sec, (*F.A. point is an indication of the free acid concentration represented by the amount of NaOH consumption in ml, obtained by using brom cresol green, and by titrating 0.1 Normal-NaOH into a 5 ml chromating solution.)

In subjecting a steel sheet to an electro-galvanizing treatment to form a first galvanizing layer on the surface thereof and then subjecting said electro-galvanized steel sheet to a conventional chromate treatment under the conditions given in (a) to (c) above, Co ion and $Cr^{3+}$, $Cr^{6+}$, In ion and/or Zr ion were added into the base galvanizing bath mentioned in (a) above in amounts as shown in Table 1. Then, the time before red rust occurrence (i.e, the bare corrosion resistance) in a salt spray test of the electro-galvanized steel sheet subjected only to the electro-galvanizing treatment, and the amount of deposited chromate and the times before white rust and red rust occurrence (i.e., the corrosion resistance after chromating) in salt spray test of the chromated electro-galvanized steel sheet were measured. The results of measurement are also indicated in Table 1.

Table 1

| | Additive into base galvanizing bath and amount of addition (ppm) | | Electro-galvanized steel sheet: Hours before red rust occurrence (bare corrosion resistance) (hr) | Chromated electro-galvanized steel sheet: Amounts of deposited chromate ($mg/m^2$) | Hours before white rust occurrence (hr) | Hours before red rust occurrence (hr) |
|---|---|---|---|---|---|---|
| Comparison 1 | None | | 18 | 18.2 | 48 | 144 |
| Comparison 2 | Co ion | 10,000 | 36 | 6.0 | 24 | 144 |
| Comparison 3 | Co ion | 20,000 | 48 | 5.3 | 24 | 144 |
| | In ion | 2,000 | | | | |
| Comparison 4 | Co ion | 20,000 | 36 | 6.0 | 24 | 144 |
| | In ion | 150 | | | | |
| Comparison 5 | Co ion | 5,000 | 48 | 10.5 | 60 | 500 min. |
| | In ion | 5,000 | | | | |
| Comparison 6 | Co ion | 20,000 | 48 | 4.8 | 24 | 144 |
| | Zr ion | 1,000 | | | | |
| Comparison 7 | Co ion | 10 | 24 | 19.1 | 48 | 144 |
| | $Cr^{6+}$ | 5 | | | | |
| | In ion | 5 | | | | |
| Comparison 8 | Co ion | 2,500 | 48 | 5.0 | 24 | 144 |
| | In ion | 5 | | | | |
| Comparison 9 | Co ion | 5,000 | 48 | 5.8 | 24 | 144 |
| | Zr ion | 5 | | | | |
| Comparison 10 | Co ion | 10 | 24 | 17.8 | 36 | 144 |
| | $Cr^{6+}$ | 10 | | | | |
| Comparison 11 | Co ion | 50 | 36 | 6.2 | 24 | 144 |
| | Zr ion | 5 | | | | |
| Example 1 | Co ion | 5,000 | 48 | 15.7 | 48 | 288 |
| | $Cr^{6+}$ | 100 | | | | |
| Example 2 | Co ion | 5,000 | 36 | 13.7 | 48 | 240 |
| | Zr ion | 2,000 | | | | |
| Example 3 | Co ion | 5,000 | 48 | 10.6 | 60 | 500 min. |
| | In ion | 2,500 | | | | |
| Example 4 | Co ion | 2,500 | 48 | 10.0 | 60 | 500 min. |
| | In ion | 2,500 | | | | |
| Example 5 | Co ion | 2,500 | 48 | 12.0 | 48 | 264 |
| | $Cr^{3+}$ | 300 | | | | |
| Example 6 | Co ion | 1,000 | 36 | 13.2 | 48 | 288 |
| | $Cr^{6+}$ | 100 | | | | |
| Example 7 | Co ion | 2,500 | 48 | 12.7 | 48 | 264 |
| | $Cr^{6+}$ | 60 | | | | |
| | In ion | 100 | | | | |
| Example 8 | Co ion | 2,500 | 48 | 10.8 | 48 | 240 |
| | $Cr^{6+}$ | 60 | | | | |
| | Zr ion | 50 | | | | |
| Example 9 | Co ion | 500 | 36 | 16.0 | 60 | 264 |
| | In ion | 500 | | | | |
| | Zr ion | 500 | | | | |
| Example 10 | Co ion | 500 | 48 | 16.3 | 60 | 312 |
| | In ion | 1,000 | | | | |
| | Zr ion | 100 | | | | |
| | $Cr^{6+}$ | 150 | | | | |

As is evident from Table 1 above, the chromated electro-galvanized steel sheet of Comparison 1 outside the scope of the present invention, in which no additive is added into the base galvanizing bath, is well comparable to Examples 1 to 10 within the scope of the present invention in terms of the amount of deposited chromate, but is inferior to the latter in terms of the bare corrosion resistance, with a shorter time before red rust occurrence of the electro-galvanized steel sheet subjected to only an electro-galvanizing treatment and also with a shorter time before red rust occurrence of the electrogalvanized steel sheet after chromating. The chromated electro-galvanized steel sheet of Comparison 2 outside the scope of the present invention, in which the base galvanizing bath is added with Co ion only, has a smaller amount of deposited chromate and shorter times before white rust and red rust occurrence after chromating.

As shown by Comparisons 3 to 11 outside the scope of the present invention, if the content of any of the additives of the present invention, if any, in the base galvanizing bath, is outside the scope of the present invention, the resulting electro-galvanized steel sheet is inferior in terms of any or both of the time before red rust occurrence of the electro-galvanized steel sheet subjected to an electro-galvanizing treatment only, and the times before white rust and red rust occurrence of the electro-galvanized steel sheet after chromating. In Comparison 5 in which the base galvanizing bath contains more In ion than that used in the present invention, substantial deposits were produced on the galvanizing electrode.

In Examples 1 to 10 within the scope of the present invention, on the contrary, both the time before red rust occurrence of the electro-galvanized steel sheet subjected to an electro-galvanizing treatment only, and the times before white rust and red rust occurrence of the electro-galvanized steel sheet after chromating are longer as compared with Comparison 1 to 11, thus showing the excellent bare corrosion resistance and corrosion resistance after chromating of the chromated electro-galvanized steel sheet in the present invention.

EXAMPLE B

Example B is an embodiment of the second process of the present invention.

A steel sheet was subjected to the first electro-galvanizing treatment of the first process of the present invention in a base galvanizing bath consisting of the chemical composition given in (a) of Example A mentioned above, added with Co ion and $Cr^{3+}$, $Cr^{6+}$, In ion and/or Zr ion in amounts indicated in Table 2, under the same electro-galvanizing conditions as those given in (b) of Example A except for the target amount of deposited zinc, to form the first galvanizing layer of the first process of the present invention. Subsequently, said electro-galvanized steel sheet with said first galvanizing layer formed thereon was subject to a second electro-galvanizing treatment in a base galvanizing bath of the composition shown in (a) of Example A, under the same electro-galvanizing conditions as those given in (b) of Example A except for the target amount of deposited zinc, to form a second galvanizing layer consisting exclusively of zinc on said first galvanizing layer. Then, said electro-galvanized steel sheet with said first and said second galvanizing layers formed thereon was subjected to a chromate treatment under the same chromating conditions as those given in (c) of Example A. The bare corrosion resistance of thus obtained electro-galvanized steel sheet, and the amount of deposited chromate, the white rust resistance and the red rust resistance of said electro-galvanized steel sheet after chromating were measured. The results of measurement are also indicated in Table 2.

Table 2

| | Additive into base galvanizing bath for forming 1st galvanizing layer and amount of addition (ppm) | | Composition of 2nd galvanizing layer | Bare corrosion resistance of electro-galvanized steel sheet (red rust resistance) (36 hr after) | Chromated electro-galvanized steel sheet | | |
|---|---|---|---|---|---|---|---|
| | | | | | Amount of deposited chromate ($mg/m^2$) | White rust resistance (48 hr after) | Red rust resistance (360 hr after) |
| Example 1 | Co ion<br>$Cr^{6+}$ | 5,000<br>100 | Zn | o | 36 | o | o |
| Example 2 | Co ion<br>Zr ion | 5,000<br>1,000 | Zn | o | 34 | o | o |
| Example 3 | Co ion<br>In ion | 5,000<br>1,000 | Zn | o | 40 | o | o |
| Comparison 1 | Galvanizing layer consisting exclusively of zinc | | | x | 38 | o | x |
| Comparison 2 | Co ion | 5,000 | — | o | 10 | x | x |
| Comparison 3 | Co ion<br>$Cr^{6+}$ | 5,000<br>100 | — | o | 19 | Δ | Δ |
| Comparison 4 | Co ion<br>In ion | 5,000<br>1,000 | — | o | 18 | Δ | Δ |
| Comparison 5 | Co ion<br>Zr ion | 5,000<br>1,000 | — | o | 19 | Δ | Δ |

In Table 2, only the first galvanizing layer of 20 $g/m^2$ was imparted to the electro-galvanized steel sheets of Comparisons 1 to 5 outside the scope of the second process of the present invention, and the double zinc layer of 20 $g/m^2$ consisting of a 18 $g/m^2$ first galvanizing layer and a 2 $g/m^2$ second galvanizing layer was imparted to the electro-galvanized steel sheets of Examples 1 to 3 within the scope of the present invention.

The bare corrosion resistance of the electro-galvanized steel sheets in Table 2 is based on the observation of the surface condition after the lapse of 36 hours in salt spray tests carried out in compliance with the Japanese Industrial Standard (JIS).Z2371; and the white rust resistance and the red rust resistance of the chromated electro-galvanized steel sheets are based on the observation of the surface conditions after the lapse of 48 hours (for the white rust resistance) and 360 hours (for the red rust resistance), respectively, in salt spray tests carried out as mentioned above. In Table 2, the mark O indicates a very good result without or with a very little rust occurrence; not so good; and X, unsatisfactory.

As is clear from Table 2, the chromated electro-galvanized steel sheet of Comparison 1 outside the scope of the present invention, with a galvanizing layer consisting exclusively of zinc, shows a low bare corrosion resistance, and hence, a low red rust resistance after chromating. The chromated electro-galvanized steel sheet of Comparison 2 outside the scope of the present invention, in which the base galvanizing bath is added with Co ion only, shows an improved bare corrosion resistance, but, unsatisfactory white rust resistance and red rust resistance after chromating. In the chromated electro-galvanized steel sheets of Comparisons 3 to 5 within the scope of the first process of the present invention, both the bare corrosion resistance and the corrosion resistance after chromating are improved as compared with Comparisons 1 to 2 outside the scope of the present invention, but the adaptability to chromating impaired by the addition of Co is not considered to have been completely restored.

In contrast, the chromated electro-galvanized steel sheets of Examples 1 to 3 within the scope of the second process of the present invention, in which the second galvanizing layer consisting exclusively of zinc is formed on the first galvanizing layer formed by the first process of the present invention, are not only excellent both in the bare corrosion resistance and the adaptability to chromating, but also superior in the corrosion resistance after chromating, because of the large amount of deposited chromate.

According to the present invention, as mentioned above in detail, it is possible to obtain a chromated electro-galvanized steel sheet excellent in the bare corrosion resistance and the corrosion resistance after chromating. In fabricating or handling it, therefore, a high corrosion resistance can well be maintained even if the chromate film is damaged. Furthermore, a chromated electro-galvanized steel sheet manufactured by the second process of the present invention is less susceptible of secular degradation of the deep-drawing formability because of the large amount of deposited chromate, thus providing industrially useful effects.

What is claimed is:

1. In a process for manufacturing an electro-galvanized steel sheet excellent in bare corrosion resistance and adaptability to chromating, wherein a steel sheet is subjected to an electro-galvanizing treatment in an acidic galvanizing bath containing Co ion, the improvement characterized by: subjecting a steel sheet to an electro-galvanizing treatment in a Zn-ion based acidic galvanizing bath containing at least one additive selected from the group consisting of:

| | |
|---|---|
| (a) $Cr^{3+}$ | 50 - 700 ppm, |
| (b) $Cr^{6+}$ | 50 - 500 ppm, |
| (c) $Cr^{3+}$ and $Cr^{6+}$ | 50 - 700 ppm, in which $Cr^{6+}$ is 500 ppm at the maximum, |
| (d) In ion | 10 - 3,000 ppm, and |
| (e) Zr ion | 10 - 2,500 ppm; |
| and | |
| (f) Co ion | 50 - 10,000 ppm, |

to form a first galvanizing layer on the surface thereof.

2. The process of claim 1, wherein said electro-galvanized steel sheet with said first galvanizing layer formed thereon is then subjected to a second electro-galvanizing treatment in a conventional acidic galvanizing bath containing zinc only to form a second galvanizing layer consisting exclusively of at least 0.2 $g/m^2$ zinc on said first galvanizing layer.

3. An electro-galvanized steel sheet excellent in bare corrosion resistance and adaptability to chromating, characterized by a first galvanizing layer thereon containing at least one compound selected from the group consisting of the oxides and hydroxides of Cr, In and Zr, and at least one compound selected from the group consisting of the oxides and hydroxides of Co.

4. The electro-galvanized steel sheet of claim 3, which comprises a second galvanizing layer consisting exclusively of at least 0.2 $g/m^2$ zinc, formed on said first galvanizing layer.

* * * * *

UNITED STATES PATENT AND TRADEMARK OFFICE

CERTIFICATE OF CORRECTION

PATENT NO. : 4,048,381

DATED : September 13, 1977

INVENTOR(S) : TAKESHI ADANIYA et al

It is certified that error appears in the above-identified patent and that said Letters Patent are hereby corrected as shown below:

Column 2, line 22: rewrite "patent" as --Patent--.
Column 5, last line: replace "500 ppm" with --50 ppm--.
At column 12, line 15: before "not so good", insert

--- Δ, ---.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*